United States Patent [19]

Erickson

[11] Patent Number: 4,832,719

[45] Date of Patent: May 23, 1989

[54] ENHANCED ARGON RECOVERY FROM INTERMEDIATE LINBOIL

[76] Inventor: Donald C. Erickson, 1704 S. Harbor La., Annapolis, Md. 21401

[21] Appl. No.: 57,168

[22] Filed: Jun. 2, 1987

[51] Int. Cl.[4] ..... F25J 3/04

[52] U.S. Cl. ..... 62/22; 62/31; 62/34; 62/39

[58] Field of Search ..... 62/9, 11, 22–28, 62/31, 32, 34, 36, 38, 39, 41, 42

[56] References Cited

U.S. PATENT DOCUMENTS

| | | | |
|---|---|---|---|
| 4,137,056 | 1/1979 | Golovko | 62/24 X |
| 4,433,989 | 2/1984 | Erickson | 62/31 X |
| 4,533,375 | 8/1985 | Erickson | 62/22 |
| 4,578,095 | 3/1986 | Erickson | 62/22 |
| 4,615,716 | 10/1986 | Cormier et al. | 62/24 |
| 4,670,031 | 6/1987 | Erickson | 62/22 |

OTHER PUBLICATIONS

Streich, et al., "Production of Large Quantities of Oxygen by an Improved Two-Column Process," Moscow IIR (XIV Congress of Refrigeration), 09-1975, pp. 513–519.

Latimer, "Distillation of Air", Chemical Engineering Progress, vol. 63, No. 2, Feb. 1967, pp. 35–59.

*Primary Examiner*—Steven E. Warner

[57] ABSTRACT

The argon recovery obtainable from a dual pressure cryogenic air distillation plant for production of high purity oxygen is increased beyond present levels without offsetting incurrence of detriments such as lower $O_2$ pressure, lower $O_2$ or $N_2$ recovery, less liquid recovery, or increased energy. This is done by providing an intermediate reflux condenser (component 8 of FIG. 1) in the argon sidearm 2*b*, and providing liquid $N_2$ via valve 9 to said condenser, thereby increasing the reboil up both argon stripper 2*a* and the lower section of 2*b* proportional to the amount of $LN_2$ evaporated in 8.

9 Claims, 4 Drawing Sheets

ENHANCED ARGON RECOVERY FROM INTERMEDIATE LINBOIL

TECHNICAL FIELD

This invention relates to processes and apparatus for separating air into at least high purity oxygen (approximately 99.5% purity or higher) and co-product crude argon (approximately 80 to 99% purity). The invention permits recovery of a substantially greater fraction of crude argon that has been possible heretofore, with only a single added latent heat exchanger and at most a negligible offsetting increased energy penalty. Argon is useful in steel production, welding, and other inert atmosphere applications.

BACKGROUND ART

An example of the typical modern approach to generating high purity oxygen plus co-product crude argon by cryogenic distillation is presented by R. E. Latimer in "Distillation of Air", *Chemical Engineering Progress,* Volume 63 No. 2, February 1967, published by the American Institute of Chemical Engineering. Other examples can be found in U.S. Pat. Nos. 4,433,990, 3,751,934, and 3,729,943.

The distillation column configuration normally encountered comprises a lower column and upper column in heat exchange relationship, i.e., a "dual pressure" column, and an auxiliary crude argon column which directly connects to an intermediate height of the upper column. Functionally, the lower column is a rectifying column which receives the cooled and cleaned supply air at its base, pressurized to about 6 ATA. The overhead rectification product $N_2$ condenses against boiling oxygen bottom product of the upper or low pressure column, which has a bottom pressure of about 1.5 ATA. The LP column has three sections which accomplish different functions. The bottom section strips argon from the oxygen so as to achieve product purity. Above this section the column is divided into two sections. One section receives (directly or indirectly) the partially evaporated kettle liquid from the HP rectifier bottom as feed, and distills or removes the nitrogen overhead from that liquid, leaving a fairly pure oxygen-argon liquid mixture which drops into the argon stripping section. The second top section is the argon rectifying section (sidearm), in which the fraction of reboil entering it from the common connection point of the three sections is rectified to crude argon overhead, plus a fairly pure oxygen-argon liquid mixture which also drops into the argon stripping section. Thus vapor transiting up through the argon stripping section splits into two streams, one continuing up the $N_2$ removal section and the other going up (reboiling) the argon rectification section. Similarly liquid transiting downward through the latter two sections combines at the common connecting point, and all the combined liquid flow continues refluxing downward through the argon stripping section.

The overhead of the argon stripping section is normally cooled (refluxed) by indirectly exchanging latent heat with at least part of the kettle liquid, and the resulting at least partially evaporated kettle liquid is fed to the $N_2$ removal section. The $N_2$ removal section is normally refluxed by direct injection of liquid $N_2$ ($LN_2$) from the HP rectifier overhead product into the top of the $N_2$ section.

The problems which limit the amount of crude argon possible to recover with the above configuration are as follows. The relative reboil rates up the two top sections of the LP column are the primary determinants of the argon recovery. About 10% of the argon appears as impurity in the oxygen product, and the remainder is split between the overhead products of the $N_2$ removal section and the argon rectification section in rough proportion to the amounts of reboil up each section. The combined reboil entering those two sections is a fixed amount, namely that going up the argon stripping section. The $N_2$ removal section has a minimum reboil requirement--the amount necessary for it to reach its feed introduction point without pinching out. The more oxygen present on the feed plate or tray, the lower that reboil requirement. This is why designs which totally evaporate kettle liquid are more efficient than those which only partially evaporate it for argon rectifier reflux. The totally evaporated feed has a higher $O_2$ content than does the vapor associated with the partially evaporated feed, and therefore is properly introduced at a lower tray height of the $N_2$ removal section.

Since there is a minimum $N_2$ removal section reboil requirement, and a fixed total amount of reboil available, there is correspondingly a maximum amount of reboil available for the argon rectifier. In order to increase argon recovery, it is necessary to either decrease the $N_2$ removal section reboil to below the minimum amount otherwise required when totally evaporated kettle liquid is fed, or to increase argon rectifier reboil to above its corresponding maximum allowed amount, or preferably do both simultaneously. This is not possible with present designs.

In one prior art reference, U.S. Pat. Nos. 3,729,943, some increase in argon recovery is achieved by increasing the reboil through the argon stripping section only. This is done by locating a latent heat exchanger at the common connection point between the three sections of the LP column, and evaporating $LN_2$ or LOX in that exchanger. By increasing reboil through the argon stripping section, a higher $O_2$ purity is obtained (assuming the same number of trays/countercurrent contact stages/theoretical plates). Thus up to 10% less argon exits with the $O_2$ product. However, the saved argon is still split in the same proportions between the $N_2$ removal section and the argon rectification section, and hence only part of it is actually recovered. This is because the reboil rates through those two sections are unchanged. Even though the latent heat exchanger is physically located in the bottom of the argon rectifier, all the trays of the argon rectifier are above the latent heat exchanger, and hence the latent heat exchanger causes no added reboil through any of the countercurrent contact part of the argon rectifier.

In the above disclosure, when $LN_2$ is evaporated at the bottom of the argon rectifier, that vapor may be work expanded to produce the required process refrigeration. That vapor is at a substantially lower pressure than the HP rectifier overhead vapor, e.g., at 4.5 ATA vice 6 ATA. Accordingly a proportionately larger amount must be expanded to produce a given refrigeration requirement. In modern "LOXBOIL" plants this will have an adverse impact on $O_2$ recovery. LOXBOIL plants are those in which the product oxygen is evaporated by latent heat exchange against either partially or totally condensing air vice against condensing HP rectifier overhead gas (typically 99+% purity $N_2$). This substantially increases the delivery pressure of the product oxygen, but it decreases the amount of $LN_2$ available to reflux the $N_2$ removal section and the HP rectifier, and thus decreases the ability to rectify the $O_2$ out of those two overhead products. LOXBOIL plants can recover about 97% of the oxygen as product provided only 8 to 10% of the feed gas is work expanded, but any additional work expansion causes a reduction in achievable $O_2$ recovery. Thus the prior art disclosure, in a LOXBOIL context, provides some additional argon recovery but at the expense of reduced product oxygen recovery, due to the higher $N_2$ flow required for refrigeration expansion.

There is another reason why attempts to increase argon recovery have an adverse impact on $O_2$ recovery of LOXBOIL plants, even in the absence of the $LN_2$ evaporator at the bottom of the argon rectifier as disclosed in the prior art. As argon recovery increases (and holding argon purity constant), there are two different and additive effects which both require increases in the reboil rate up the argon rectification section. First, greater mass flow out the top (overhead product) at a fixed column L/V will require a linearly proportional increase in V (reboil). More importantly, however, as the argon recovery increases, the argon concentration at the common connecting point between the three LP column sections decreases. For most modern LOXBOIL plants having an argon recovery of about 60%, that concentration is about 7 or 8% argon. For zero recovery, it must increase to about 17%, to force all the argon up the $N_2$ removal section. If full recovery were possible, it would decrease to about 4%. As argon recovery is increased, and the connecting point concentration correspondingly decreases, the feed vapor to the argon rectification section is located lower on the equilibrium line of the McCabe-Thiele diagram, and hence a decreased L/V is actually required, thus further increasing both the reboil and reflux requirement for a given argon recovery.

With two requirements to increase the reboil and reflux, more kettle liquid must be evaporated to supply the reflux; at the limit, all is evaporated. This, however, shifts, the $N_2$ removal section feed point substantially down the equilibrium line, to the extent that the $LN_2$ reflux available to the $N_2$ removal section can no longer rectify sufficient oxygen out of the overhead nitrogen, and hence $O_2$ recovery suffers.

From the foregoing it can be seen that the need which exists in this technical field, and one objective of the present invention, is to provide a means for increasing argon recovery in dual pressure cryogenic air separation plants without decreasing the oxygen recovery, purity, or delivery pressure, or increasing the input energy requirements. Specifically, the objectives are to increase the argon rectifier reboil rate and preferably also decrease the $N_2$ removal section reboil rate relative to what is possible now, without decreasing $O_2$ recovery, and with only one added heat exchanger; to provide additional refrigeration without decreasing the reflux available to the $N_2$ removal section overhead; to recover a greater fraction of the increased argon obtained from increased reboil through the argon stripper via $LN_2$ depressurization; and other objectives.

These objectives apply to "gas only" plants, and also to plants having part or all of their product in liquid phase. Also, in many plants which recover both high purity oxygen and crude argon, it is also desired to recover substantial quantities of coproduct nitrogen at a pressure above the LP column pressure, either as gas or liquid. The above objectives apply to those plants also.

Copending U.S. Pat. No. 4,670,031 issued to Donald C. Erickson on June 2, 1987 discloses two methods of achieving the above objectives, both of which involve an intermediate reflux condenser associated with the argon rectifier or sidearm. In one method, intermediate height liquid from the $N_2$ removal section of the LP column is supplied to the intermediate reflux condenser, and the resulting vapor is returned to the $N_2$ removal section as intermediate reboil therefor. In the second method, liquid $N_2$ ($LN_2$) is evaporated in the intermediate reflux condenser and subsequently work expanded. The present invention is a further extension of that second method, in recognition of the facts that the same advantageous objectives can be achieved without the work expansion step, and even further advantages are obtainable by incorporating refrigeration $N_2$ companding, and/or TC LOXBOIL with liquid air split, and/or companding of the TC LOXBOIL air, and/or kettle liquid distillation for overhead refluxing of the argon rectifier.

Refrigeration $N_2$ companding is disclosed in copending application No. 8831230 filed on July 2, 1986 by Donald C. Erickson. Companded TC LOXBOIL plus liquid air split is disclosed in copending application 853461 filed on Apr. 18, 1986 by Donald C. Erickson.

Refluxing of the argon rectifier overhead via kettle liquid distillation, and resultingly feeding two vapor streams of differing $O_2$ content to the $N_2$ removal section, is disclosed in copending application 893045 filed Aug. 1, 1986 by Donald C. Erickson.

Additional prior art patents pertinent to this invention include U.S. Pat. Nos. 2,411,680, 2,672,031, 2,779,174, 3,605,423, 4,099,945, and 4,133,662. Additional general background art is in the technical article, "Production of Large Quantities of Oxygen by an Improved Two-Column Process", Moscow IIR (XIV International Congress of Refrigeration), Sept. 1975, by Martin Streich and Josef Dworschak.

DISCLOSURE OF INVENTION

It has now been discovered that the problems identified in the prior art practice of argon recovery from cryogenic air separation plants or processes may be overcome by providing a dual pressure air separation apparatus comprised of high pressure rectifier and low pressure column comprised of $N_2$ removal section, argon stripping section, and argon rectifying section, wherein the improvement comprises incorporating a latent heat exchanger in said apparatus which provides intermediate height reflux to the argon rectifier and which evaporates liquid nitrogen at a pressure intermediate to the HP rectifier pressure and the LP column pressure. The intermediate pressure will normally be in the range of 3 to 5 ATA, and the intermediate height of the argon rectifier will preferably have between 4 and 10 theoretical stages of vapor liquid contact below it, although any number from about 2 to about 40 will provide some advantage.

The $LN_2$ may be obtained directly from the overhead reflux condenser of the HP rectifier via an expansion valve, or it may be obtained at least partly from a separate $LN_2$ expansion cycle. The evaporated $LN_2$ at intermediate pressure may be partially rewarmed and then work expanded to provide refrigeration, or may be withdrawn as product, or may be warmed, compressed, cooled, and then partially expanded in a liquefaction cycle. In other words, the improvement to argon recovery is generic and will find application in several variations of air separation cycle.

Further advantageous results are obtained by incorporating one or more of the novelties disclosed above from the copending applications in conjunction with the $LN_2$ cooled intermediate reflux condenser in which liquid $N_2$ is boiled ("LINBOIL").

BEST MODE FOR CARRYING OUT THE INVENTION

Figure 1:
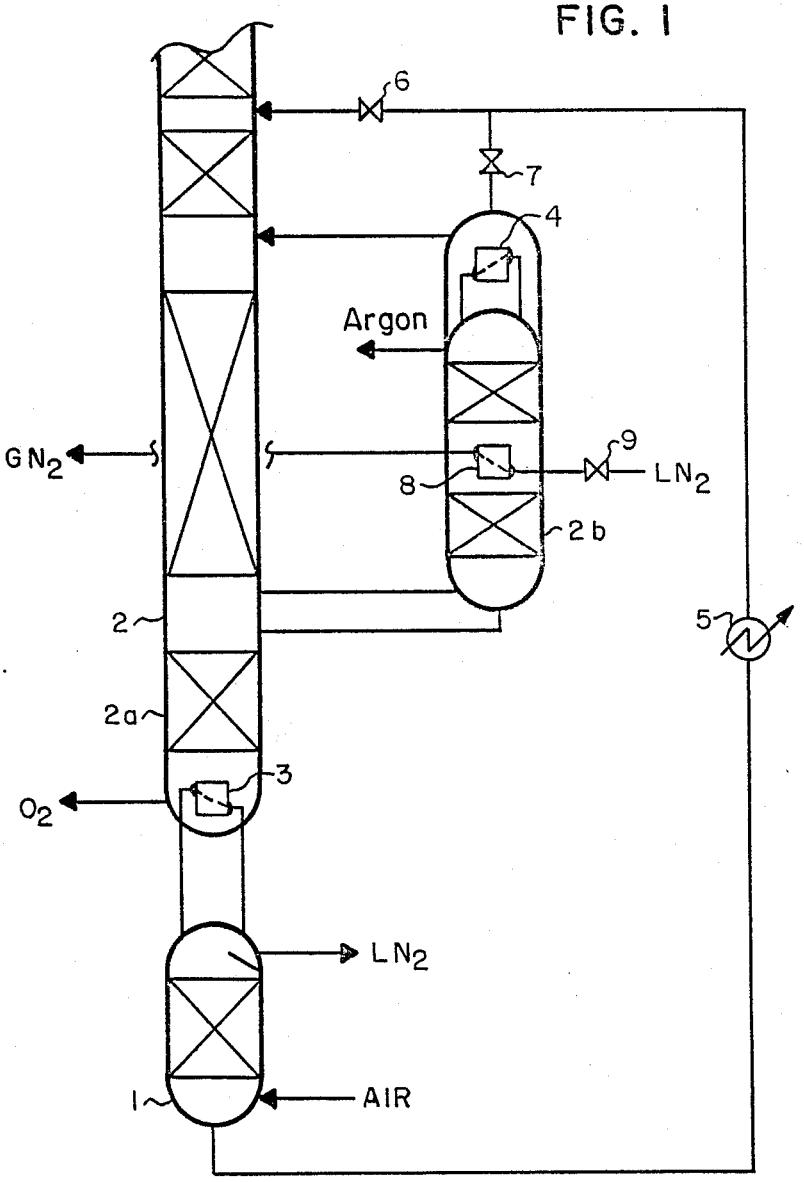
FIG. 1 is a generic representation of a simplified flowsheet of the essence of the invention.

Referring to FIG. 1, a conventional dual pressure cryogenic air distillation apparatus is provided comprised of HP rectifier 1, low pressure column 2 comprised of argon stripping section 2*a*, argon rectifier 2*b*, and the remainder, which is then $N_2$ removal section, only partially shown. The conventional apparatus is additionally comprised of HP rectifier overhead reflux condenser/LP column bottom reboiler 3, and overhead reflux condenser 4 for the argon sidearm. In the most usual prior art practice the HP rectifier bottom liquid (kettle liquid) is sensibly cooled at 5 (e.g., by heat exchange with LP column overhead $N_2$ vapor) and divided into two liquid streams by valves 6 and 7, one for direct injection as liquid into column 2, and the other for supply to condenser 4 where it is at least partially evaporated and then fed to a lower feed height (than that from valve 6) of column 2.

The presently disclosed novelty is the addition of intermediate reflux condenser 8 to the argon rectifier, including a supply of liquid $N_2$ via valve 9 which is evaporated in 8 at a pressure between that of rectifier 1 and column 2, i.e., in the approximate range of 3 to 5 ATA.

In comparison to the prior art disclosure of locating a condenser cooled by $LN_2$ at the bottom of rectifier 2*b*, which does not increase the reboil rate through any of the countercurrent vapor liquid contact section of 2*b*, with the present disclosure the reboil rate through the section of argon rectifier 2*b* below condenser 4 is increased an amount proportional to the amount of $LN_2$ evaporated at 4. And as explained above, that increase in reboil rate entering the argon rectifier, relative to the reboil rate entering the $N_2$ removal section, is what is necessary in order to increase the recovery of crude argon.

Having as few as one or two stages of theoretical vapor-liquid contact below condenser 8 will cause some increase in argon recovery. Further increases are obtained until approximately 5 to 10 theoretical trays or stages are located below condenser 8. No further increase is obtainable thereafter from added trays below condenser 8. The only benefit of more than about 10 theoretical stages below 8 is that fewer stages will be required above condenser 8 to reach a specified level of purity. On the other hand, there is a detriment associated with having more than 10 stages below condenser 8: the higher the argon concentration at 8, the lower the temperature, and hence the lower the pressure at which the liquid $N_2$ boils. With 5 to 10 theoretical stages below 8 the $LN_2$ boils at a temperature only about 1° C. below the temperature at the bottom of 2*b*, and the argon concentration at 8 is in the approximate range of 20 to 50%. If condenser 8 is moved all the way to the top of 26, however, the $LN_2$ boiling temperature is more than 3° C. below that at the bottom of 2*b*. It is very desirable to maintain the maximum $N_2$ intermediate pressure possible, irrespective of whether the $N_2$ is expanded for refrigeration, compressed for eventual liquefaction, or simply withdrawn as product.

Figure 2:
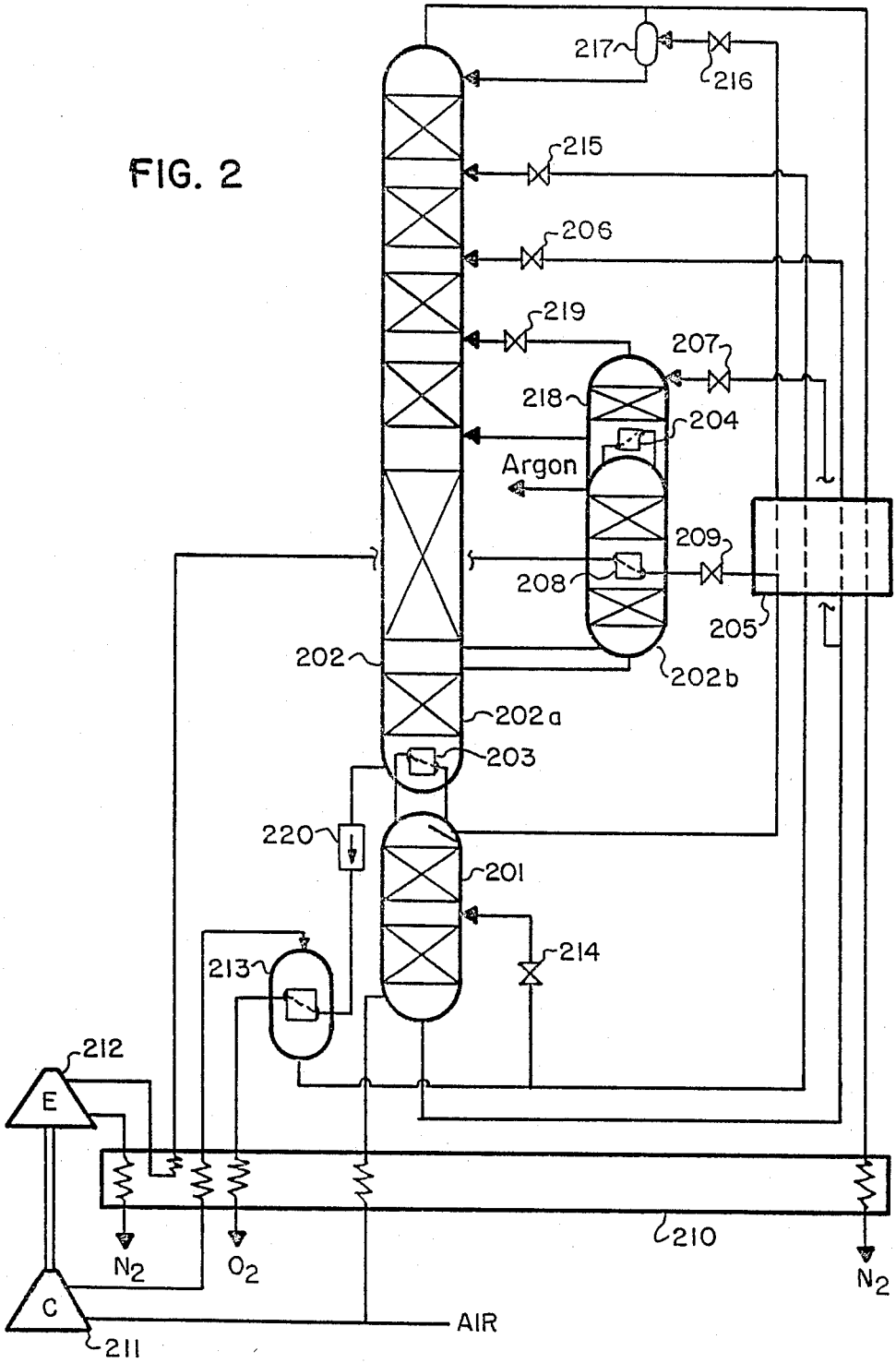
FIG. 2 is a more detailed flowsheet of one embodiment of the invention wherein gaseous $O_2$ is desired at as high a pressure as possible, and hence companding is applied to the TC LOXBOIL air.

Referring to FIG. 2, components numbered 201 through 209 are similar in function and description to the correspondingly numbered components 1 through 9 from FIG. 1. A major portion of the compressed and cleaned supply air is cooled in main exchanger 210 and fed to rectifier 201. Another portion of the compressed and cleaned supply air, amounting to about 28 moles per 100 moles of compressed air (28 m/mca) is further compressed while still warm by compressor 211, which in conjunction with cold expander 212 comprises a compander. The further compressed air is cooled and then supplied to LOXBOIL evaporator 213, where it is essentially totally condensed. The resulting liquid air is divided into two direct injection intermediate height reflux streams, one for rectifier 201 via valve 214, and the other to column 202 via valve 215 and heat exchanger 205. Gaseous high purity oxygen is withdrawn from 213 as product at a pressure higher than the sump pressure of column 203. Liquid $N_2$ from reflux condenser is divided into three streams: part directly refluxes rectifier 201; part is depressurized by valve 209 to an intermediate pressure and is boiled in 208; and part is depressurized by valve 216 for refluxing column 202 (via optional phase separator 217) and heat exchanger 205). Component 208 provides a significant increase in argon recovery, on the order of 10 to 15% more than possible with prior art teachings, due to the increased reboil rate through 202*a* and the bottom section of 202*b*. Another increase in reboil rate is obtained from component 218, a means for achieving approximately one theoretical stage of vapor-liquid contact between the kettle liquid supplied at 207 and the evaporation occurring at 204. The net effect is that the kettle liquid from 207 is evaporated into two streams of differing $O_2$ content, one having more $O_2$ than kettle liquid, and the other less. The relative amounts of each may be regulated via small adjustments of optional valve 219. The vapor stream from below the contact stage 218 has higher $O_2$ content than evaporated kettle liquid, and hence is properly fed to a lower tray height of the $N_2$ removal column than would be appropriate for evaporated kettle liquid. Thus a lower reboil rate is required in the $N_2$ removal section below that feed tray height, and hence a correspondingly higher reboil rate is allowed up the argon rectifier. This effect will also increase the argon recovery about 10% beyond that of conventional plants. With both the "intermediate LINBOIL" technique and the "kettle liquid distillation" technique applied to the same flowsheet, the argon recovery is increased more than 20% beyond that achievable with conventional flowsheets, and yet requires only a single added latent heat exchanger and a single contact stage—a truly unprecedented result.

The coproduct argon may be withdrawn directly as vapor, or as liquid, e.g., for subsequent evaporation at higher pressure and purification. The remaining numbered component on FIG. 2, 220, is indicative of the fact that the liquid oxygen being evaporated in 213 is at higher pressure than that in the sump of 202*a*. For example, if the sump of 202*a* is at 1.4 ATA, the gaseous $O_2$ from 213 would be at about 2.0 ATA. If there is sufficient height difference between 202*a* and 213, on the order of 5 meters, then the hydrostatic head of liquid $O_2$ is adequate to create that pressure difference. Otherwise 220 would be liquid pump. By companding the TC LOXBOIL air, $O_2$ delivery pressures comparable to those possible with PC LOXBOIL are obtained. Furthermore, by splitting the liquid air into two intermediate reflux streams, the loss of $O_2$ recovery characteristic of PC LOXBOIL is avoided.

Figure 3:
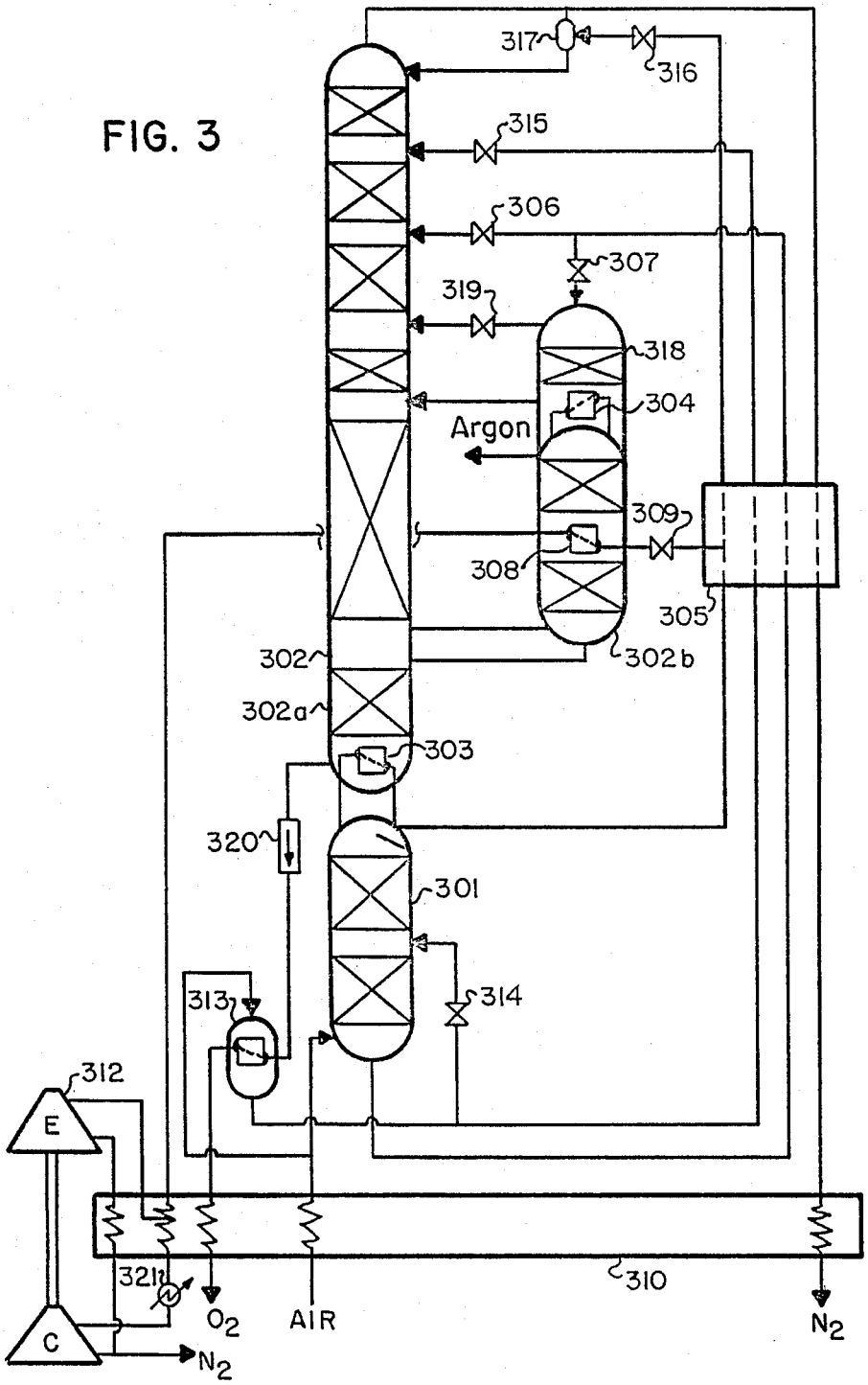
FIG. 3 is a flowsheet of the embodiment wherein the companding is applied to the $N_2$ refrigeration stream rather than to the LOXBOIL air. This increases the $O_2$ or $N_2$ recovery a small amount, at the expense of lower $O_2$ delivery pressure.

The FIG. 2 flowsheet will require about 30% more $N_2$ flow to expander 212 for a given amount of refrigeration production than that required from the HP rectifier overhead, due to the lower pressure of the former. This will frequently translate to either lower $O_2$recovery or lower recovery of coproduct $N_2$. Those disadvantages can be avoided, and the $N_2$ expander flow can be reduced to conventional levels, by applying the companding to the $N_2$ expander vapor rather than to the TC LOXBOIL air. As disclosed in copending application 881230, there are three ways this can be done. FIG. 3 illustrates one way, by way of example.

The numbered components 301 through 320 of FIG. 3 are similar in function and description to the corresponding 200-series components of FIG. 2, with the exception of compressor 311. Compressor 311 boosts the pressure of a minor fraction (about 20 to 30%) of the expander exhaust $N_2$ back to expander inlet pressure, for recycle.

Since the TC LOXBOIL air is no longer companded, the LOX evaporates at about 1.8 ATA vice 2.0. The two alternative ways of companding the expansion $N_2$ are: (1) expand the $N_2$ to mildly below atmospheric pressure, then use the compressor to raise it to atmospheric (discharge) pressure; (2) warm the intermediate pressure $N_2$, compress it to higher pressure, cool it, then expand it to conventional discharge pressure.

The two $LN_2$ streams supplied respectively to the $N_2$ removal section and to the LINBOIL condenser need not be taken from the same height of the HP rectifier. For example, if the evaporated intermediate pressure $N_2$ is desired as coproduct, it may be desired to have it at relatively high purity, in which case it would be taken from a higher tray height. If pressurized $N_2$ coproduct is desired, then the supply air can be expanded in the refrigeration expander prior to feeding to the HP rectifier. Alternatively, as another example, the intermediate pressure $N_2$ vapor can be supplied to a liquefaction cycle which incorporates an expander for providing both process and liquefaction refrigeration. That is the flowsheet depicted in FIG. 4.

Figure 4:
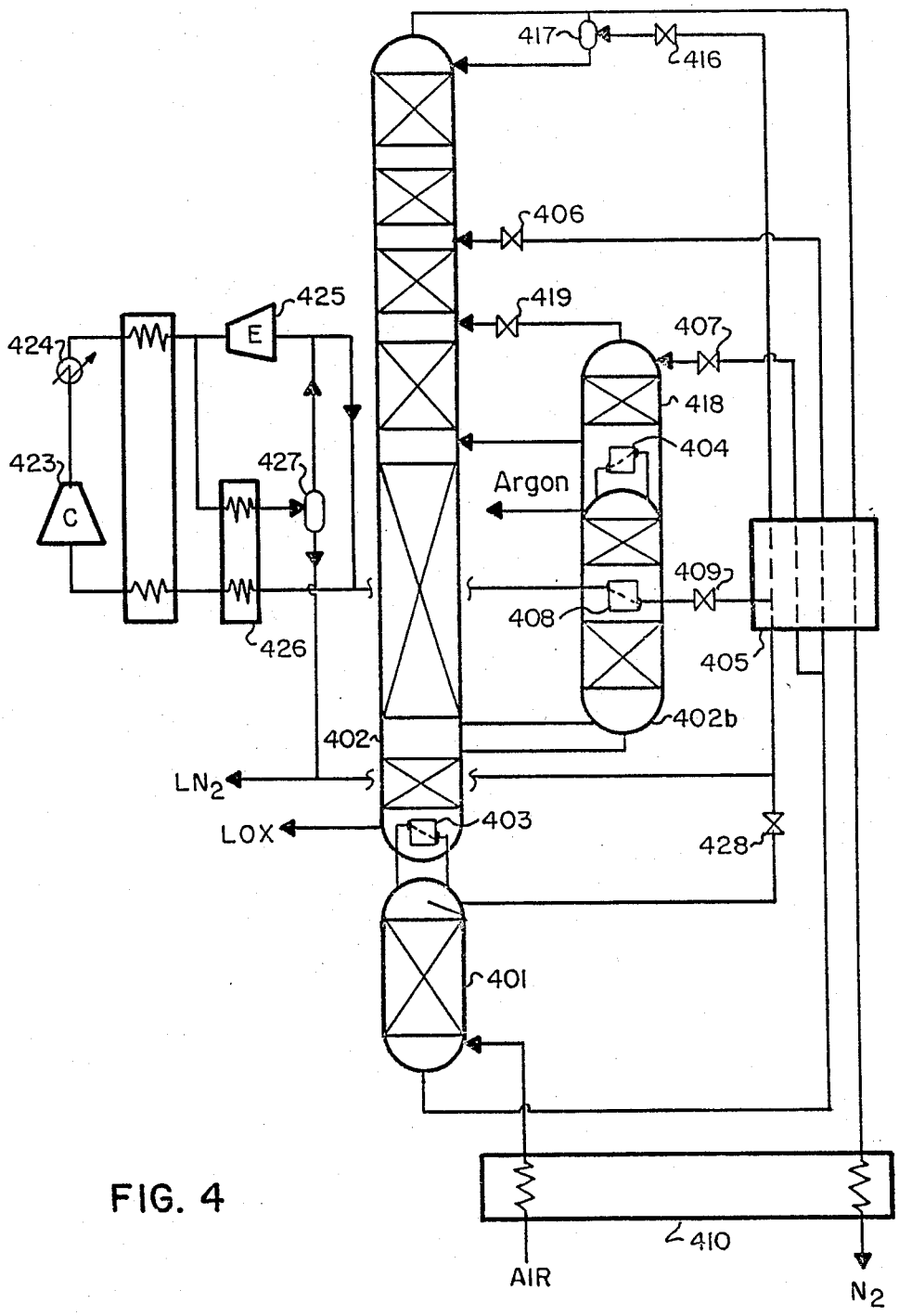
FIG. 4 is a flowsheet of the argon intermediate LINBOIL disclosure applied to an air separation plant incorporating a liquefaction cycle.

Referring to FIG. 4, components numbered 419 or lower correspond in function and description to similarly numbered components of FIG. 2. Since LOX, $LN_2$, and crude argon are the products, there is no need for a LOX evaporator, a compander, or a means for splitting liquid air. Instead, the intermediate pressure $N_2$ vapor from intermediate reflux condenser 408 is supplied to a liquefaction cycle comprised of sensible heat exchanger 422, compressor 423, external cooler 424, work expander 425, liquefaction exchanger 426, and phase separator 427. The vapor from expander 425 and separator 427 is joined with that from 408 for recycle. The $LN_2$ may be joined with that from the HP rectifier or kept separate, and either source can be used to supply 408. It will be apparent that other liquefaction arrangements employing a dual pressure column with argon sidearm plus intermediate LINBOIL condenser are also possible.

In summary, a new process and/or apparatus is disclosed for increasing argon recovery from air distillation plants which encompasses any application of said plants: production of gas only, part or all liquid, with or without coproduct $N_2$, etc.

The scope of the disclosed novelty is not to be limited to the specific examples cited above, but rather extended to the full breadth of the disclosure as defined by the following claims.

As mentioned above, there will be some benefit of increased argon recovery even when the LINBOIL condenser is at the overhead of the argon rectifier, provided one of the other measures which preserve $LN_2$ (increase $O_2$ recovery) is present, e.g., LAIRSPLIT and/or companding of the refrigeration $N_2$.

Coproduct $N_2$ yields of 8 to 22 m/mca are possible under this disclosure.

I claim:

1. A process for the fractional distillation of air into at least high purity oxygen plus crude argon comprising:

a. rectifying at least part of a supply of compressed, cleaned, and cooled air in a high pressure (HP) rectifier to $N_2$ overhead product and kettle liquid bottom product;

b. refluxing said HP rectifier and reboiling a low pressure (LP) column comprised of argon stripper, argon rectifier, and $N_2$ removal section by exchanging latent heat in a reboiler/reflux condenser between HP rectifier overhead $N_2$ and argon stripper bottom liquid oxygen.

c. refluxing an intermediate height of said argon rectifier by exchanging latent heat in an intermediate reflux condenser with liquid $N_2$ which is at a pressure intermediate to said HP rectifier pressure and said LP column pressure;

d. providing approximately five to ten theoretical stages of countercurrent vapor-liquid contact in said apron rectifier below said intermediate reflux condenser;

e. maintaining the argon concentration at said intermediate reflux condenser in the approximate range of 20 to 50%; and f. evaporating between 8 and 22 moles of liquid nitrogen per 100 moles of compressed supply air in said intermediate reflux condenser.

2. Process according to claim 1 further comprising:

a. supplying part of said kettle liquid directly to said $N_2$removal section as feed therefor after appropriate depressurization;

b. supplying the remaining depressurized kettle liquid to an apparatus comprised of an overhead reflux condenser for said argon rectifier plus at least one stage of vapor-liquid countercurrent contact for said depressurized kettle liquid, whereby said kettle liquid is evaporated into two vapor streams of differing $O_2$ content; and c. separately feeding said two vapor streams to different heights of said $N_2$ removal section.

3. Process according to claim 1 further comprising dividing the $LN_2$obtained from said reboiler/reflux condenser into three streams, and supplying one to the HP rectifier as reflux therefor, one to the $N_2$ removal section as reflux therefor, and the remaining one to said intermediate reflux condenser after depressurizing to said intermediate pressure.

4. Process according to claim 3 further comprising withdrawing liquid oxygen bottom product from said argon stripper and supplying it to a liquid oxygen (LOX) evaporator which is at a higher pressure than and preferably also at a lower elevation than said argon stripper.

5. Process according to claim 4 further comprising supplying heat to said LOX evaporator by total condensation of a remaining minor fraction of said supply air.

6. Process according to claim 5 further comprising dividing the resulting liquid air into two streams for respective feeding to intermediate reflux heights of said HP rectifier and said $N_2$removal section.

7. Process according to claim 6 further comprising:

a. partially warming and then work expanding said evaporated intermediate pressure $N_2$; and b. powering a warm compressor from said expansion work, thereby additionally compressing said minor fraction of supply air prior to said total condensation.

8. An apparatus for production of high purity oxygen plus crude argon by fractional distillation of air in a dual pressure column with argon sidearm wherein the improvement is characterized by:

a. intermediate reflux condenser for said argon sidearm;

b. first conduit for supplying intermediate pressure liquid nitrogen to said intermediate reflux condenser as cooling means therefor;

c. second conduit for withdrawing evaporated nitrogen from said intermediate reflux condenser.

d. a liquid oxygen evaporator for evaporation of the liquid oxygen product from said dual pressure column by latent heat exchange with a minor fraction of said supply air which is totally condensed thereby; and e. a means for dividing the resulting condensed liquid air stream into at least two streams for respective feeding to intermediate reflux locations of both the high pressure and low pressure portions of said dual pressure column.

9. Apparatus for production of high purity oxygen plus coproduct argon comprising:

a. high pressure rectifier;

b. low pressure column comprised of argon stripper, argon rectifier, and $N_2$ removal section;

c. reboiler/reflux condenser which exchanges latent heat between HP rectifier overhead vapor and argon stripper bottom liquid;

d. reflux condenser for the argon rectifier which is cooled by partially depressurized liquid $N_2$ from said HP rectifier and which is located such that at least part of the zone of countercurrent vapor liquid contact in said argon rectifier is below it;

e. liquid oxygen (LOX) evaporator which exchanges latent heat between liquid oxygen from said argon stripper and part of the supply air which is totally condensed therein; and f. liquid air splitter which directs part of the liquid air from said LOX evaporator to intermediate heights of each of said HP rectifier and said $N_2$ removal section.

* * * * *